US012042038B2

(12) United States Patent
Pyne

(10) Patent No.: US 12,042,038 B2
(45) Date of Patent: Jul. 23, 2024

(54) COSMETIC BRUSH COVER

(71) Applicant: TTR LAKESHORE, Chicago, IL (US)

(72) Inventor: Maribeth Pyne, Chicago, IL (US)

(73) Assignee: TTR LAKESHORE, Chicago, IL (US)

( * ) Notice: Subject to any disclaimer, the term of this patent is extended or adjusted under 35 U.S.C. 154(b) by 402 days.

(21) Appl. No.: 16/911,595

(22) Filed: Jun. 25, 2020

(65) Prior Publication Data

US 2020/0405048 A1 Dec. 31, 2020

Related U.S. Application Data

(60) Provisional application No. 62/868,164, filed on Jun. 28, 2019.

(51) Int. Cl.
*A46B 17/04* (2006.01)
*A46B 9/02* (2006.01)

(52) U.S. Cl.
CPC ..... *A46B 17/04* (2013.01); *A46B 9/021* (2013.01); *A46B 2200/1046* (2013.01)

(58) Field of Classification Search
CPC . A46B 17/04; A46B 9/021; A46B 2200/1046; A46B 17/02; A46B 15/0091; A45D 44/18; A45D 24/08
(Continued)

(56) References Cited

U.S. PATENT DOCUMENTS 919,440 A * 4/1909 Lawson ..... A46B 17/04 401/269
980,678 A * 1/1911 Roche ..... A46B 17/04 401/269
(Continued)

FOREIGN PATENT DOCUMENTS

CA 2742629 A1 * 12/2012 ..... A46B 17/04
CH 99877 A * 6/1923 ..... A46B 17/04
(Continued)

OTHER PUBLICATIONS

Franz Schönenberger, "CH 714543 B1 Translated" (Year: 2021).*
(Continued)

*Primary Examiner* — Jacqueline T Johanas
*Assistant Examiner* — Holly T. To
(74) *Attorney, Agent, or Firm* — MEDLER FERRO WOODHOUSE & MILLS PLLC

(57) ABSTRACT

The present disclosure provides a cover for a cosmetic brush that includes a handle, a ferrule, and bristles. The cover comprises a body having substantially the same shape of the ferrule and bristles and comprising a stretchable and conformable material, the body having an internal volume sufficient to contain the entirety of the ferrule and bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough; and a flap distally extending from the first end of the body, the flap configured to fold over the body to substantially cover the first opening and comprising a closure mechanism capable of attaching to the body. The cover is capable of holding the cosmetic brush substantially in place. Also provided herein is a covered cosmetic brush.

11 Claims, 16 Drawing Sheets

(58) Field of Classification Search
USPC ..... 206/361, 209; 150/161
See application file for complete search history.

(56) References Cited

U.S. PATENT DOCUMENTS 1,153,730 A * 9/1915 Thompson ..... A46B 17/04 206/361
1,168,423 A * 1/1916 Rodgers ..... A46B 17/04 206/361
1,612,887 A * 1/1927 Saunders ..... B44D 3/125 206/361
1,834,374 A * 12/1931 Berg ..... A46B 17/04 206/361
1,852,679 A * 4/1932 Schneider ..... B65D 75/02 206/362.4
1,938,442 A * 12/1933 Stuart ..... B44D 3/125 206/362.4
2,004,320 A * 6/1935 Hanson ..... B44D 3/125 206/362.4
3,000,491 A * 9/1961 McIntosh ..... B65D 75/02 220/315
3,136,409 A * 6/1964 Schumann ..... A46B 17/04 206/361
3,167,178 A * 1/1965 Saunders ..... B65D 75/02 206/361
3,860,115 A * 1/1975 Laske ..... A46B 17/04 493/203
4,469,223 A * 9/1984 Smith ..... A46B 17/04 206/209
4,751,762 A * 6/1988 Meimeteas ..... A46B 17/00 16/110.1
4,821,361 A * 4/1989 Meimeteas ..... A46B 17/00 15/168
4,847,939 A * 7/1989 Derencsenyi ..... A46B 17/04 16/110.1
5,084,932 A * 2/1992 Zanchi ..... A46B 11/0093 15/168
D329,144 S * 9/1992 Kurtz ..... D4/199
D350,234 S * 9/1994 Losole ..... D4/199
5,358,107 A * 10/1994 Laske ..... A46B 17/04 206/362.4
5,577,607 A * 11/1996 Drake ..... A45D 1/00 206/349
5,791,608 A * 8/1998 Nielsen ..... B44D 3/125 206/362.4
D408,151 S * 4/1999 Drees ..... D4/199
D436,450 S * 1/2001 Wilson ..... D4/199
6,199,694 B1 * 3/2001 Van Diest ..... A46B 17/04 220/4.24
6,338,406 B1 * 1/2002 Zagar ..... A46B 17/04 206/362.2
6,450,336 B1 * 9/2002 Edes ..... A46B 17/04 206/209
6,575,295 B2 * 6/2003 Mayfield ..... B44D 3/125 206/362.4
D510,813 S * 10/2005 Gilman ..... D9/422
D511,412 S * 11/2005 Madrid ..... D4/199
7,111,354 B2 * 9/2006 Nennig ..... A46B 17/04 15/247
7,207,437 B1 * 4/2007 Johansson ..... B44D 3/125 206/361
8,157,091 B2 * 4/2012 Gabbard ..... A46B 17/04 206/362.4
8,607,979 B1 * 12/2013 Cody ..... B44D 3/125 206/362
8,668,085 B1 * 3/2014 Oliver ..... A46B 17/04 15/247
9,167,891 B2 * 10/2015 Shaughness ..... A46B 17/04
9,392,866 B1 * 7/2016 Klinsport ..... A46B 17/04
9,402,465 B1 * 8/2016 LaForge ..... A46B 15/0091
9,849,366 B1 * 12/2017 Thornbury ..... A63C 11/023
9,944,113 B2 * 4/2018 DePaola, Jr. ..... B44D 3/123
10,986,915 B2 * 4/2021 Meyer ..... A46B 9/10
D927,784 S * 8/2021 Kim ..... D28/73
11,241,086 B1 * 2/2022 Sholeen ..... B44D 3/125
11,607,904 B2 * 3/2023 Verheijen ..... B44D 3/125
2002/0179115 A1 * 12/2002 Alex ..... A46B 17/08 15/247
2003/0062280 A1 * 4/2003 Davis ..... B44D 3/123 206/362.4
2003/0138170 A1 * 7/2003 Breil, Jr. ..... B65D 33/2533 383/86
2004/0168700 A1 * 9/2004 Dorf ..... A45D 33/00 132/313
2004/0187888 A1 * 9/2004 Vandyke ..... A45D 44/18 132/309
2004/0250840 A1 * 12/2004 Baker ..... A46B 17/04 15/247
2005/0141787 A1 * 6/2005 Breil, Jr. ..... B65D 33/2533 229/80
2005/0160550 A1 * 7/2005 Reeves ..... A46B 17/08 15/247
2005/0233283 A1 * 10/2005 Clennon ..... A45D 44/18 433/80
2006/0174906 A1 * 8/2006 Ord ..... A45D 24/10 132/147
2007/0170079 A1 * 7/2007 Gangemi ..... A46B 17/04 206/361
2007/0199575 A1 * 8/2007 Del Ponte ..... A46B 15/0091 132/320
2009/0194444 A1 8/2009 Jones
2011/0108444 A1 * 5/2011 Shaughness ..... A46B 17/04 150/161
2013/0056377 A1 * 3/2013 Shaughness ..... A46B 17/04 206/361
2013/0111688 A1 * 5/2013 Lim ..... A46B 17/04 15/247
2015/0223593 A1 * 8/2015 Sguera ..... A46B 17/08 15/175
2016/0007724 A1 * 1/2016 Fee ..... A46D 1/0207 15/190
2016/0193867 A1 * 7/2016 Souffle ..... B44D 3/125 206/361
2016/0278455 A1 * 9/2016 Johnson ..... A41D 13/065
2016/0332480 A1 * 11/2016 Martin ..... B44D 3/125
2017/0055686 A1 * 3/2017 Lavin ..... A45F 5/00
2017/0071327 A1 * 3/2017 Fleischer ..... A46B 15/00
2017/0238695 A1 * 8/2017 Morgan ..... B44D 3/125
2018/0027957 A1 * 2/2018 Hill ..... A46B 9/021
2019/0365087 A1 * 12/2019 Boutorine ..... B32B 5/26
2022/0031059 A1 * 2/2022 Lamont ..... A46B 17/04
2022/0202270 A1 * 6/2022 Park ..... A47L 13/51
2022/0378187 A1 * 12/2022 York ..... A46B 5/00
2022/0378190 A1 * 12/2022 Hwang ..... D21H 27/02
2022/0395067 A1 * 12/2022 Sung ..... A45D 34/045
2023/0034251 A1 * 2/2023 Wenninger ..... B25G 1/102

FOREIGN PATENT DOCUMENTS

CH 714543 B1 * 7/2021 ..... B32B 25/16
CN 2539426 Y * 3/2003
CN 201660112 U 12/2010
CN 201979769 U * 9/2011
CN 201979769 U 9/2011
EP 3025872 A1 * 6/2016 ..... A46B 17/04
FR 848337 A * 10/1939
GB 334745 A * 9/1930
GB 334745 A * 10/1930 ..... B32B 25/16
GB 2514381 A * 11/2014 ..... A46B 17/04
GB 2555539 A * 5/2018 ..... B63C 11/08
JP 2007-268100 A 10/2007
JP 2007268100 A * 10/2007
JP 3148537 U 1/2009
JP 3148537 U * 2/2009
JP 2014188248 A * 10/2014
KR 20180087626 A * 8/2018

(56) References Cited

FOREIGN PATENT DOCUMENTS

| | | | | |
|---|---|---|---|---|
| WO | WO-9529607 | A1 * | 11/1995 | ..... A45C 11/008 |
| WO | WO-2020264106 | A1 * | 12/2020 | ..... A46B 17/04 |

OTHER PUBLICATIONS

Rakuten Store Suguremono A, Item No. 10002427, available at <https://item.rakuten.co.jp/kodawarido/10002427/>; accessed on May 2, 2019.

Rakuten Store Suguremono A, Item No. 10002021, available at <https://item.rakuten.co.jp/kodawarido/10002021/>; accessed on May 2, 2019.

International Search Report and Written Opinion in PCT/US2020/039543, mailed Sep. 29, 2020.

* cited by examiner

COSMETIC BRUSH COVER

FIELD OF THE INVENTION

The present disclosure provides a cover for a cosmetic brush that includes a handle, a ferrule, and bristles. The cover comprises a body having substantially the same shape of the ferrule and bristles and comprising a stretchable and conformable material, the body having an internal volume sufficient to contain the entirety of the ferrule and bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough; and a flap distally extending from the first end of the body, the flap configured to fold over the body to substantially cover the first opening and comprising a closure mechanism capable of attaching to the body. The cover is capable of holding the cosmetic brush substantially in place. A covered cosmetic brush is also provided herein.

BACKGROUND

Cosmetic brushes are typically used for application of makeup to sensitive areas of a user, e.g., face and neck regions. Since the bristles of cosmetic brushes are in direct contact with the skin, an important aspect of brush maintenance includes keeping the cosmetic brush clean in order to avoid introducing sources of irritation and/or infection of the skin, as well as the eyes, nose and mouth. Exposure of the bristles during storage of cosmetic brushes may render them susceptible to contamination, e.g., by particles such as dust, bacteria, and viruses. Contact with moisture during storage should also be avoided.

A further aspect of cosmetic brush maintenance includes maintaining the shape of the bristles. Bristle deformation can occur during storage, as certain storage conditions can force the bristles into an unnatural shape. Bristle deformation can also occur during the insertion of a cosmetic brush into or removal from a cover or container that may not be well-aligned with the bristles. Deformed bristles can create inconvenience and reduce precision when applying makeup.

Clean and secure storage of cosmetic brushes can be difficult. For example, thinner brushes may be prone to slipping out of covers or sleeves. For thicker brushes, e.g., bronzer or fan brushes that have wide bristle shapes, bristles may become easily deformed if not carefully handled.

Embodiments of the present disclosure provide a cover for a cosmetic brush. Also provided herein is a covered cosmetic brush.

SUMMARY OF THE INVENTION

In some embodiments, the present disclosure is directed to a cover for a cosmetic brush including a handle, a ferrule, and bristles, the cover comprising a body having substantially the same shape of the ferrule and comprising a stretchable and conformable material, the body having an internal volume sufficient to contain the entirety of the ferrule and bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough; and a flap distally extending from the first end of the body, the flap configured to fold over the body to substantially cover the first opening and comprising a closure mechanism capable of attaching to the body, wherein the cover is capable of holding the cosmetic brush substantially in place.

In further embodiments, the present disclosure provides a cover for a cosmetic brush including a handle, a ferrule, and bristles, the cover comprising a body having substantially the same shape of the ferrule, the body comprising neoprene, spandex, or combination thereof and having an internal volume sufficient to contain the entirety of the ferrule and the bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough, wherein the first opening has a larger width than an unstretched width of the second opening, and the body comprises a tapered portion configured to limit movement of the ferrule, or wherein the first and second openings have substantially the same unstretched width; and a flap distally extending from the first end of the body, the flap configured to fold over the body to substantially cover the first opening and comprising a hook and loop fastener for attachment to a corresponding hook and loop fastener on the body, wherein the cover is capable of holding the cosmetic brush substantially in place.

In yet further embodiments, the present disclosure provides a covered cosmetic brush, comprising a cosmetic brush including a handle, a ferrule, and bristles; and a cover comprising a body having substantially the same shape of the ferrule, the body comprising neoprene, spandex, or combination thereof and having an internal volume sufficient to contain the entirety of the ferrule and the bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough; and a flap distally extending from the first end of the body and having a length less than or substantially equal to the length of the body, the flap configured to fold over the body to cover the first opening and comprising a hook and loop fastener for attachment to a corresponding hook and loop fastener on the body, wherein the cover holds the cosmetic brush substantially in place.

BRIEF DESCRIPTION OF THE DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention.

It should be noted that drawings are not to scale, and measurements listed in the drawings for various components of the covers and brushes described herein are exemplary. A person of ordinary skill in the art will readily understand that other measurements can be used in preparing the covers described herein, and will be dictated largely by the size of brush that is desired to be covered.

DETAILED DESCRIPTION OF THE INVENTION

Figure 1A:
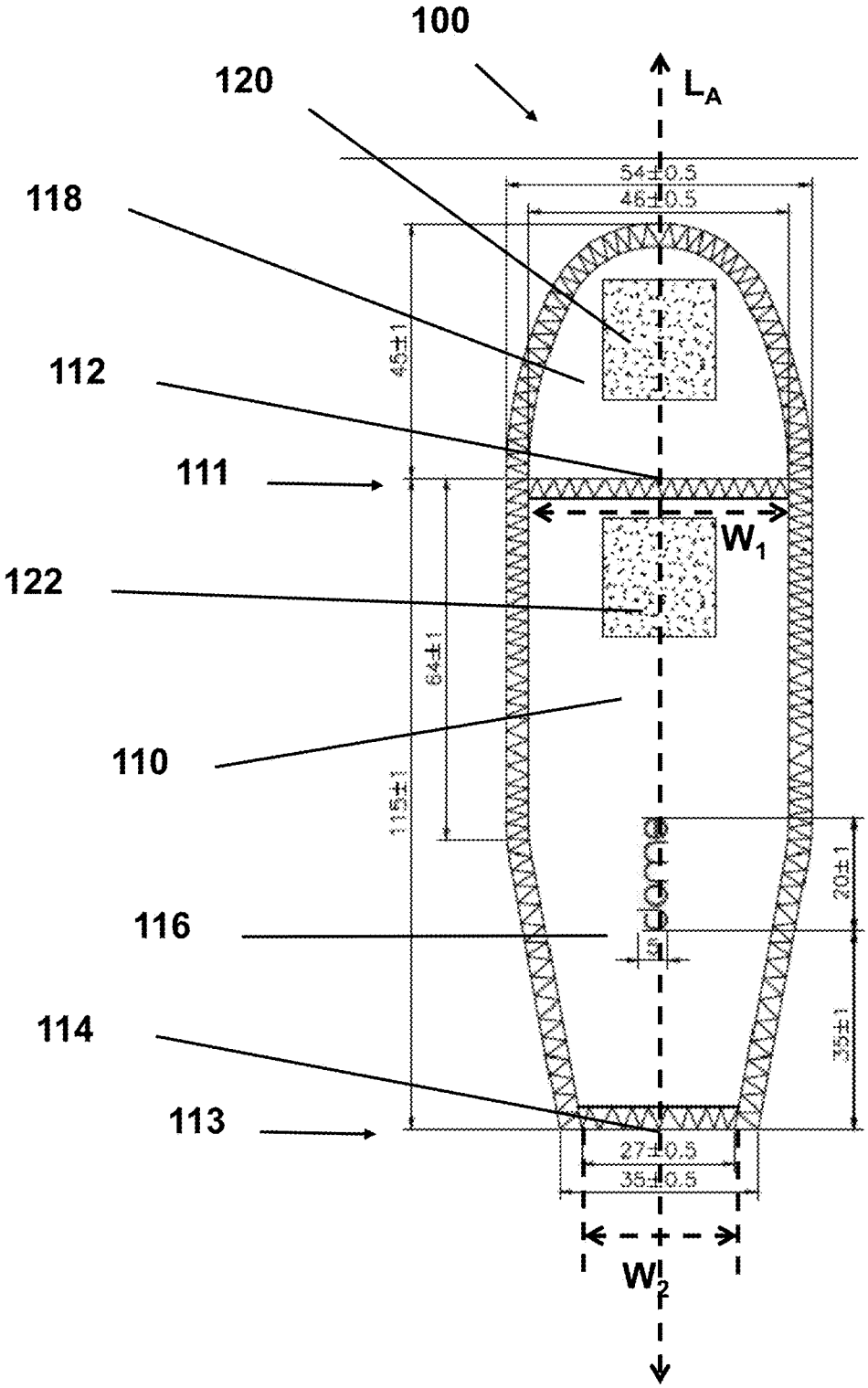
FIG. 1A illustrates a top down view of a cover for a cosmetic brush according to embodiments herein.

The following detailed description is merely exemplary in nature and is not intended to limit the invention or the application and uses of the invention. Furthermore, there is no intention to be bound by any expressed or implied theory presented in the preceding field of the invention, background, summary or the following detailed description.

As used in this specification, the singular forms "a," "an" and "the" specifically also encompass the plural forms of the terms to which they refer, unless the content clearly dictates otherwise. The term "about" is used herein to mean approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 20%. It should be understood that use of the term "about" also includes the specifically recited number of value.

Embodiments of the present invention are directed to a cover for a cosmetic brush that includes a handle, a ferrule, and bristles. The cover includes: a body having substantially the same shape of the ferrule and comprising a stretchable and conformable material, the body having an internal volume sufficient to contain the entirety of the ferrule and bristles; a first opening at a first end of the body for receiving the cosmetic brush in a handle-first orientation; a stretchable second opening at a second end of the body, the second opening being less than or substantially the same width as the ferrule and capable of stretching to admit the ferrule therethrough; and a flap distally extending from the first end of the body, the flap configured to fold over the body to substantially cover the first opening and comprising a closure mechanism capable of attaching to the body, wherein the cover is capable of holding the cosmetic brush substantially in place.

FIGS. 1-5 illustrate top views of a cover 100 for cosmetic brush 200 in accordance with embodiments of the present invention. In such embodiments, cosmetic brush 200 includes handle 212, ferrule 210, and bristles 214. Cover 100 includes body 110, which has a first opening 112 at a first end 111 and a second opening 114 at a second end 113. Cover 100 also includes flap 118 that extends distally from first end 111 of body 110 and comprises closure mechanism 120. Closure mechanism 120 is configured to attach to closure mechanism receiver 122 on body 110.

Figure 1B:
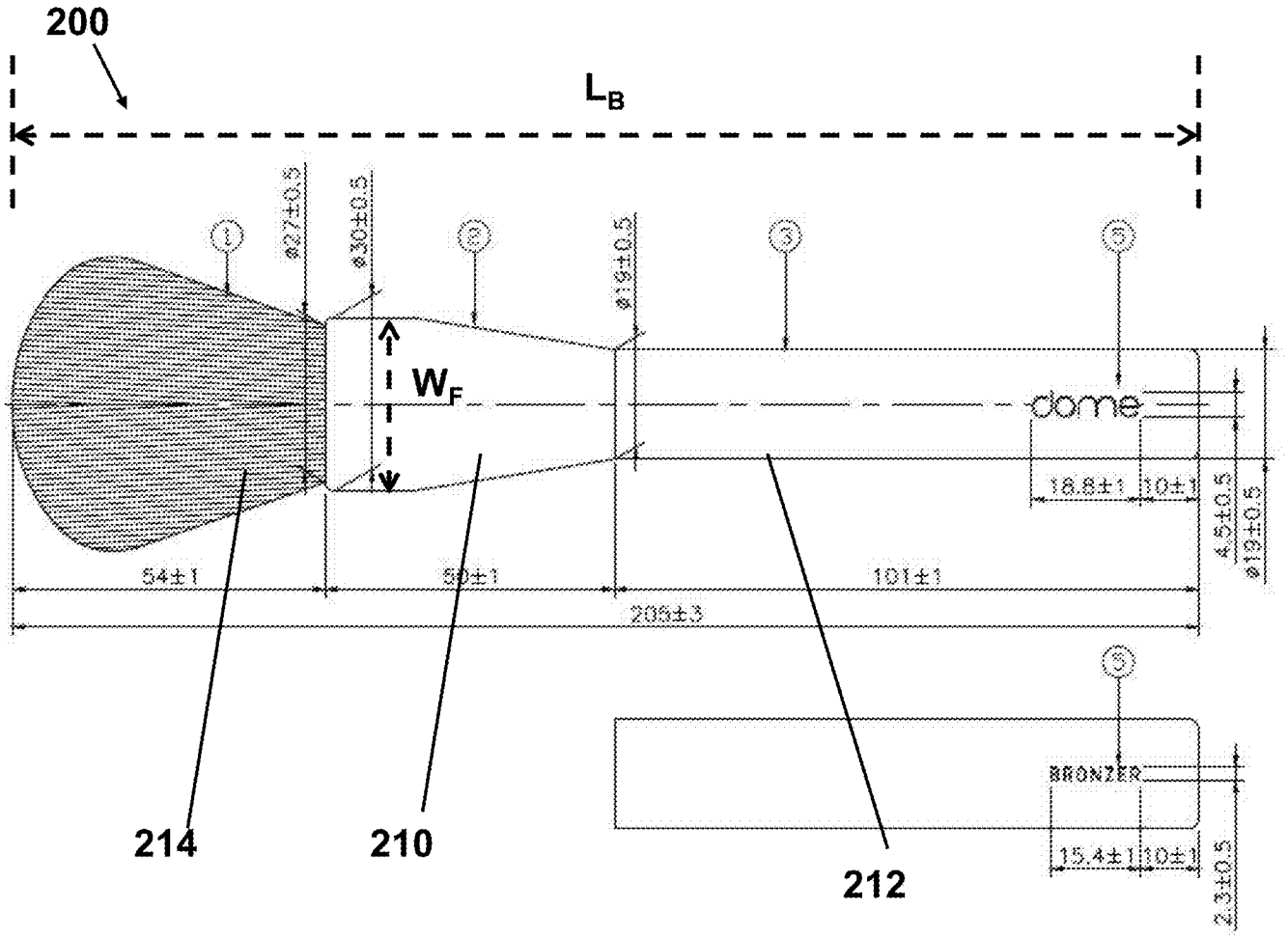
FIG. 1B illustrates a side view of an exemplary bronzer cosmetic brush.
Figure 2A:
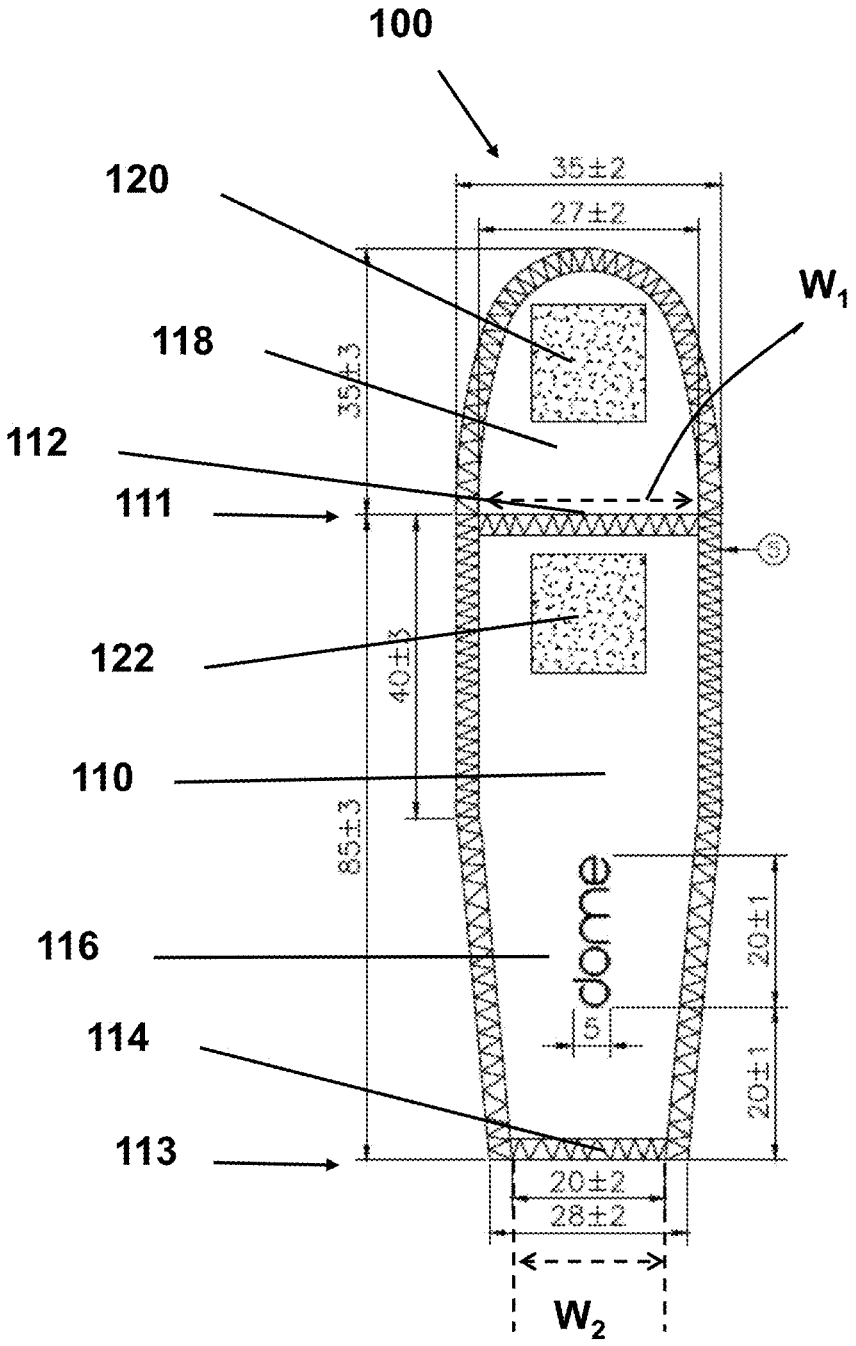
FIG. 2A further illustrates a top down view of a cover for a cosmetic brush, according to embodiments herein.
Figure 2B:
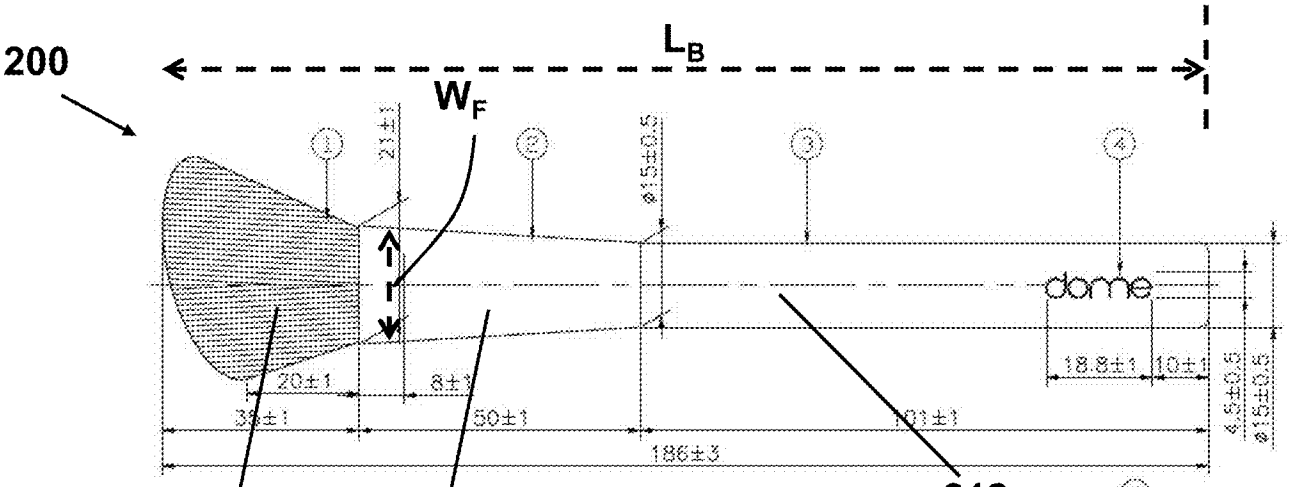
FIGS. 2B and 2C respectively illustrate two side views of an exemplary blush cosmetic brush.
Figure 3A:
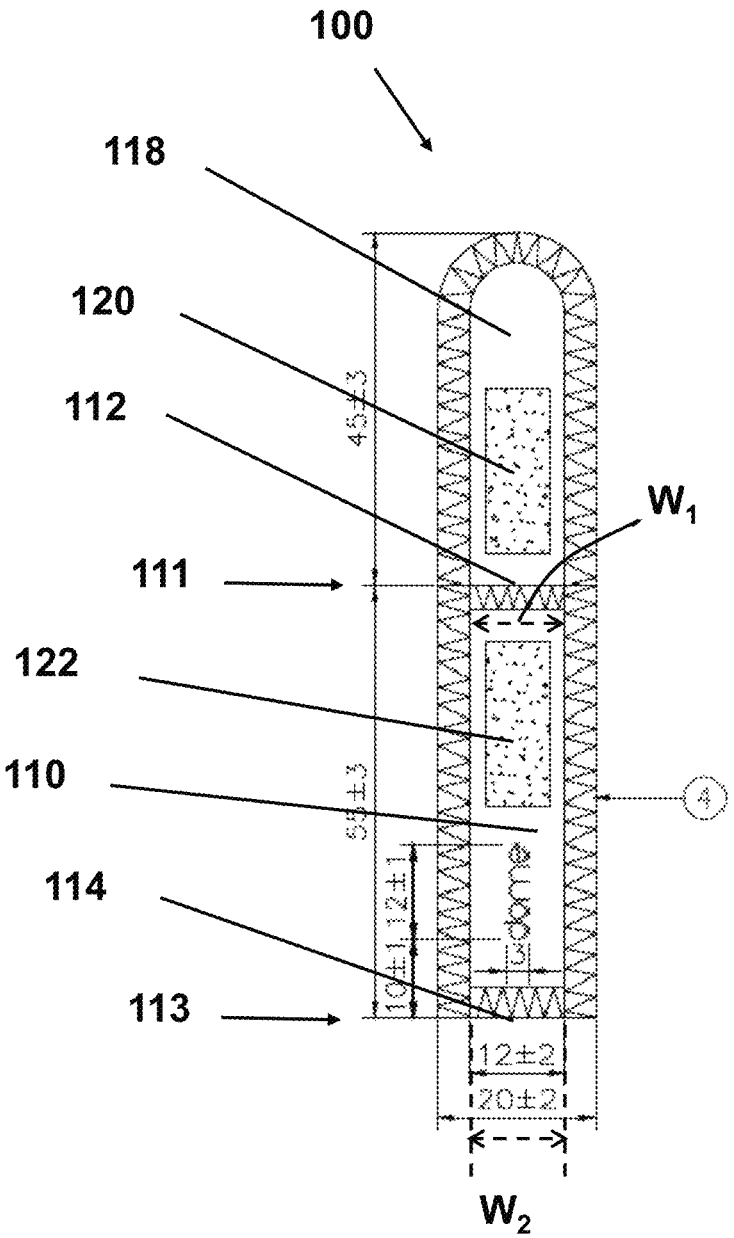
FIG. 3A further illustrates a top down view of a cover for a cosmetic brush, according to embodiments herein.
Figure 3B:
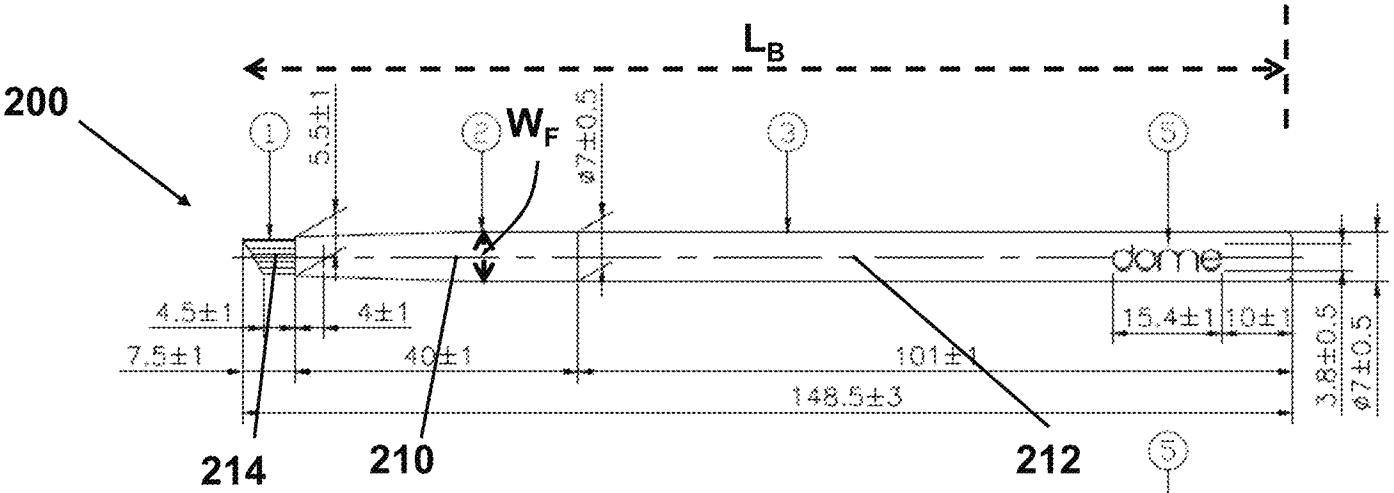
FIGS. 3B and 3C respectively illustrate two side views of an exemplary angled liner cosmetic brush.
Figure 3C:
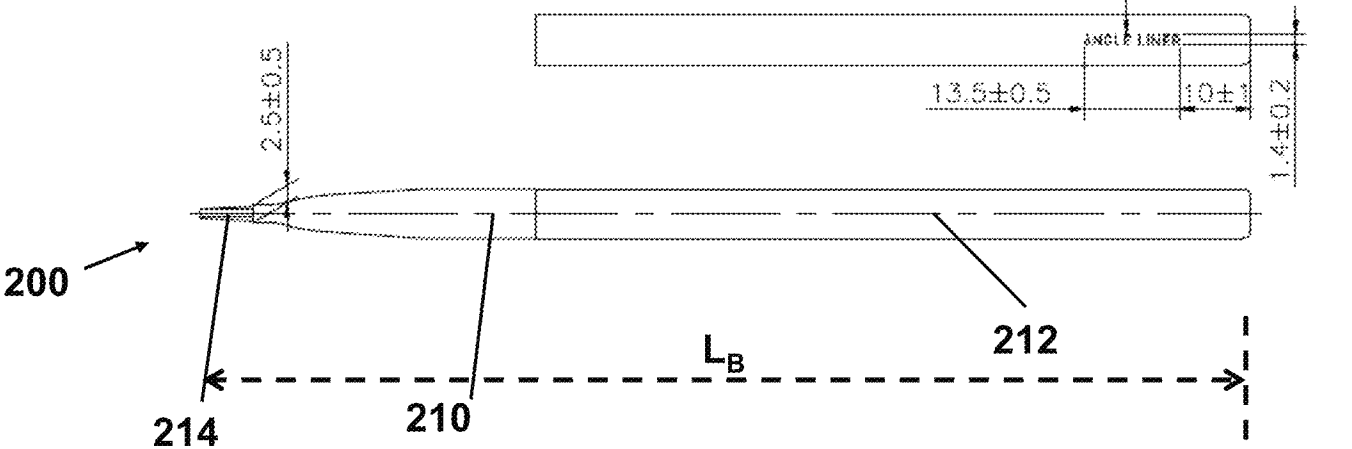
Figure 4A:
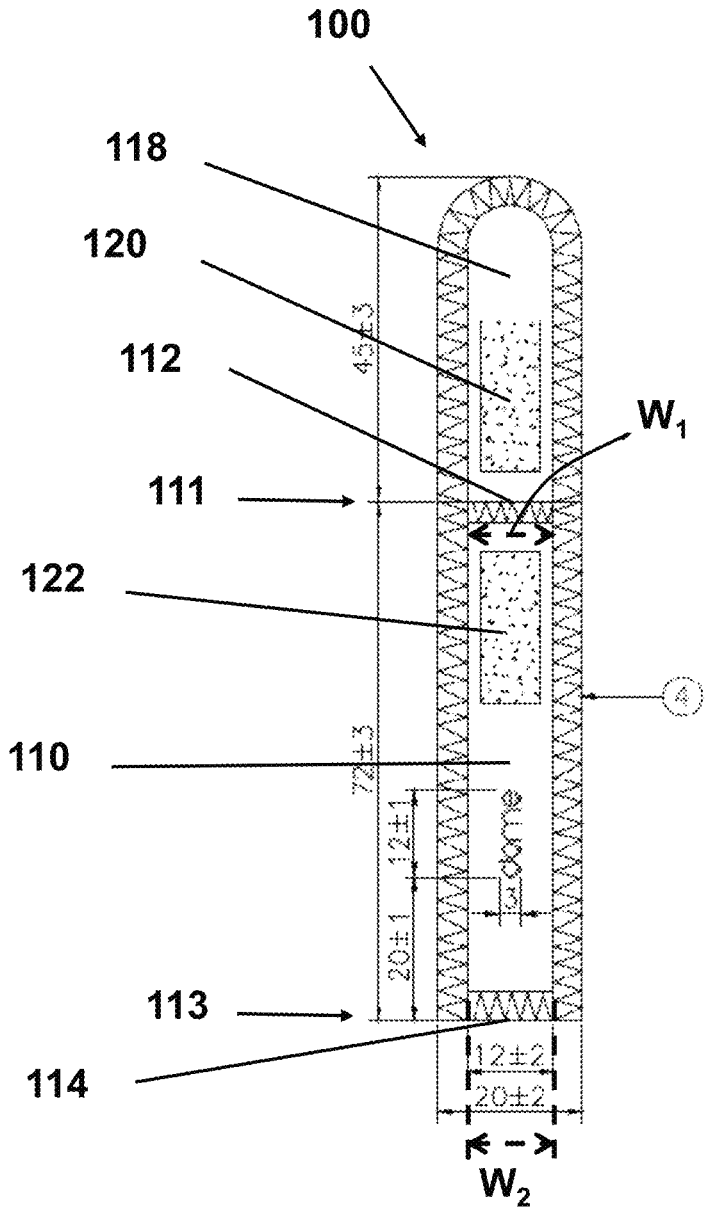
FIG. 4A further illustrates a top down view of a cover for a cosmetic brush, according to embodiments herein.
Figure 4B:
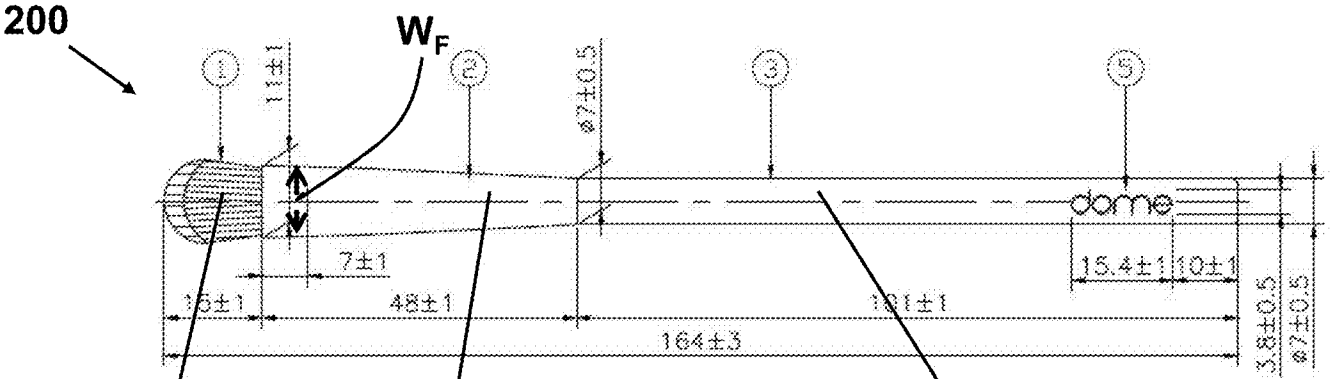
FIGS. 4B and 4C respectively illustrate two side views of an exemplary flat eyeshadow cosmetic brush.
Figure 4C:
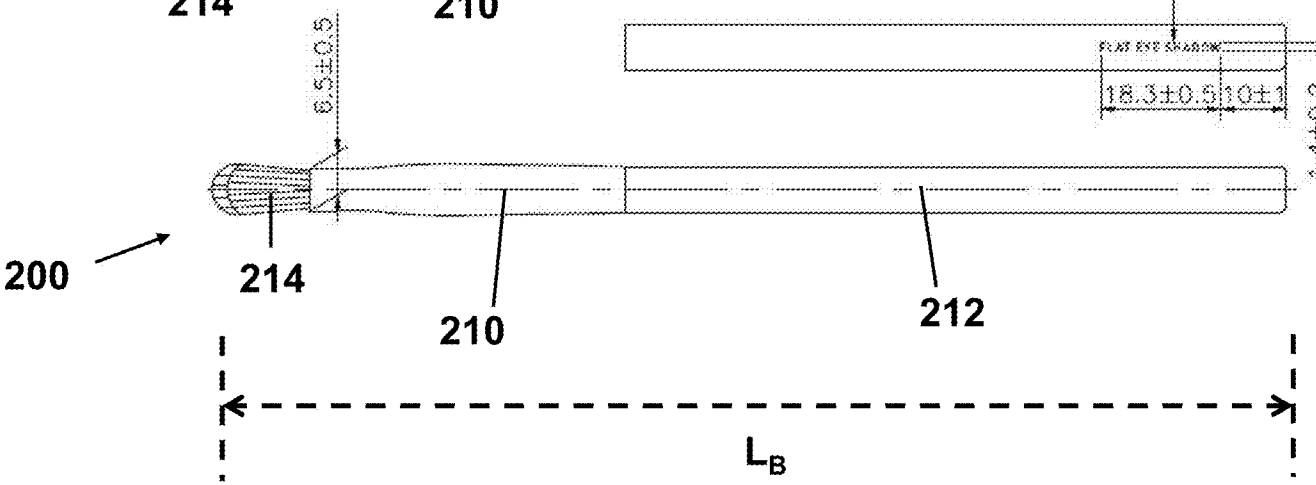
Figure 5A:
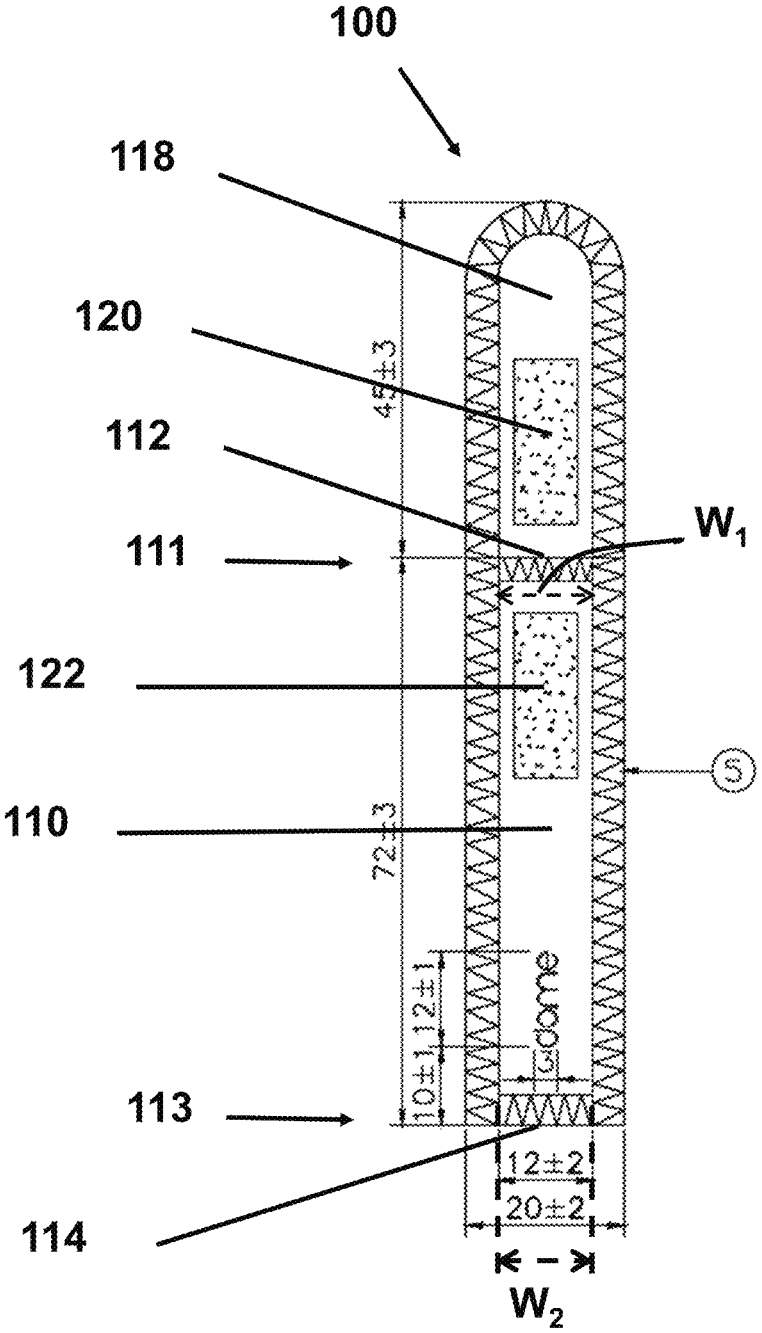
FIG. 5A further illustrates a top down view of a cover for a cosmetic brush according to embodiments herein.
Figure 5B:
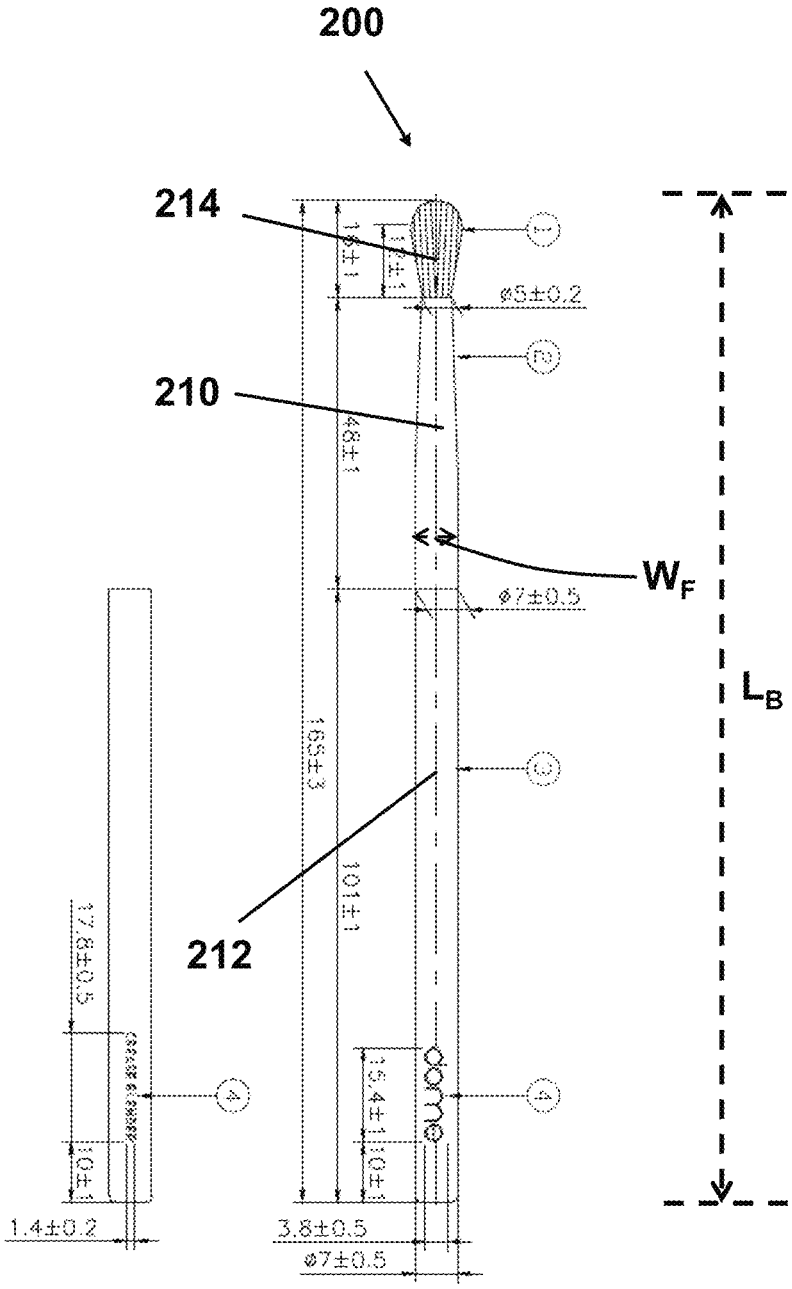
FIG. 5B illustrates a side view of an exemplary blender cosmetic brush.

In embodiments, body 110 has substantially the same shape of ferrule 210 and bristles 214. By "substantially the same shape," it is meant that body 110 has the same general shape as the shape of ferrule 210 and bristles 214, such that an entire three-dimensional outline of the body covers an entire three-dimensional outline of the ferrule and bristles. Body 110 can also include portions that specifically match the shape of bristles 214 and/or ferrule 210. For example, ferrule 210 can be tapered, e.g., as illustrated in FIGS. 1B and 2B, and body 110 can include a corresponding tapered portion 116 that generally matches the same tapered shape of the ferrule, e.g., as illustrated in FIGS. 1A and 2A. In another example, ferrule 210 is not tapered, e.g., as illustrated in FIG. 5B, and body 100 also does not have a tapered portion to generally match the same shape of the ferrule, e.g., as illustrated in FIG. 5A. In a further example, ferrule 210 can be slightly tapered, e.g., as illustrated in FIGS. 3B and 4B, while body 110 does not include a tapered portion, e.g., as illustrated in FIGS. 3A and 4A. In each embodiment illustrated in FIGS. 1-5, body 110 is considered to have substantially the same shape as ferrule 210 and bristles 214. Such a design advantageously maintains the shape of bristles 214 when contained within body 110. Thus, in some embodiments, the shape of bristles 214 is not substantially deformed by cover 100.

Figure 5C:
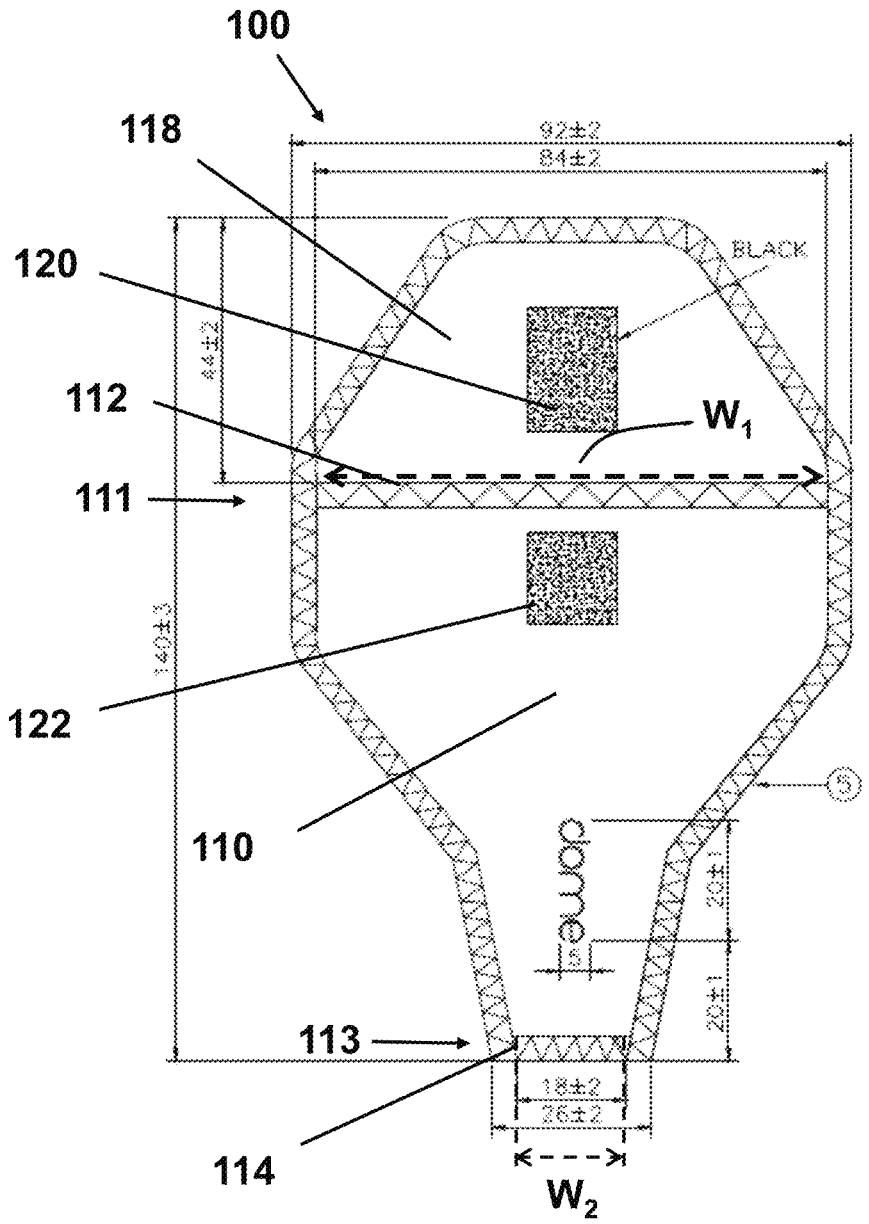
FIG. 5C further illustrates a top down view of a cover for a cosmetic brush according to embodiments herein.
Figure 5D:
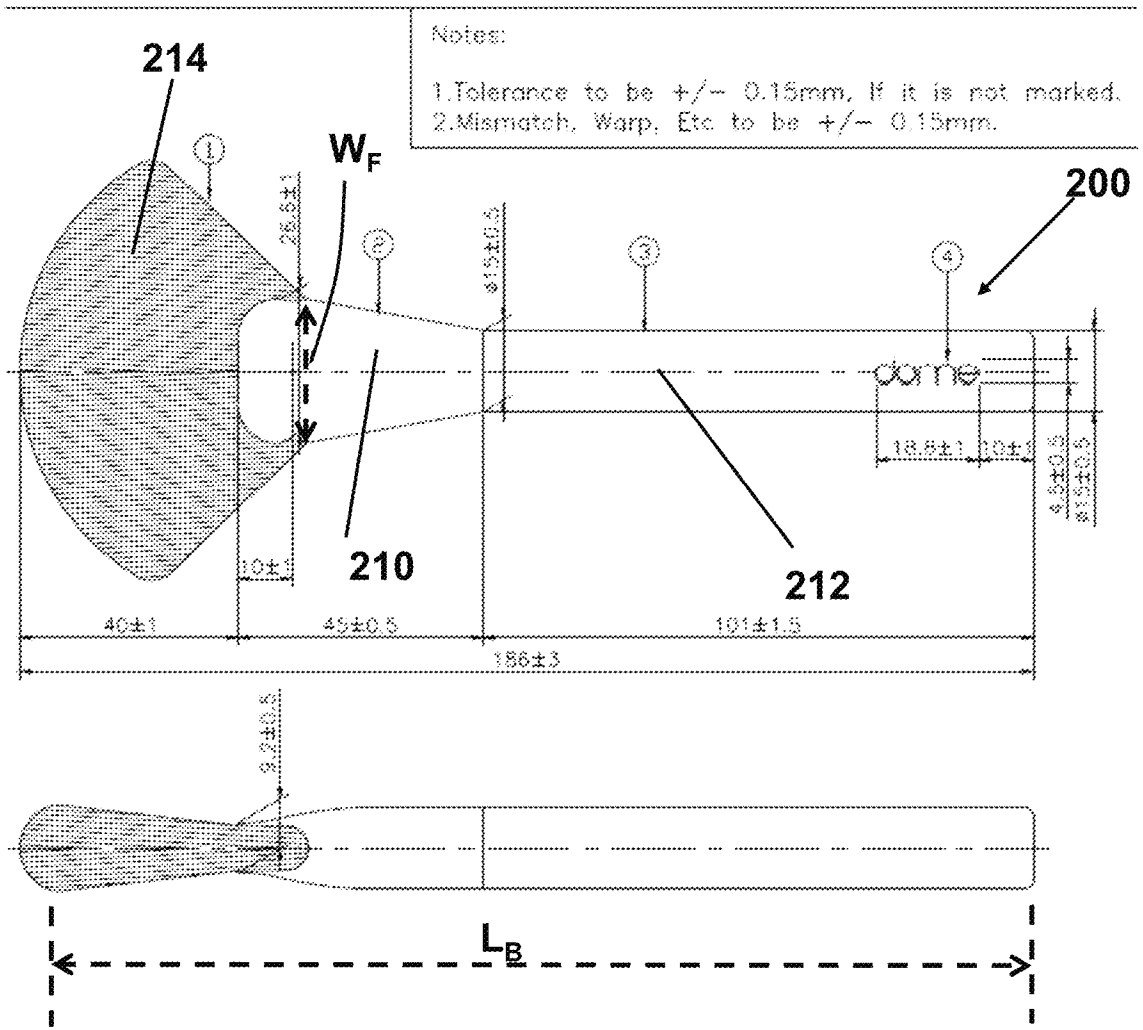
FIG. 5D illustrates side views of an exemplary fan cosmetic brush.

FIGS. 5C and 5D show an embodiment in which a fan brush with cover 100 is shown. As illustrated, bristles 214 extend outward beyond the width of ferrule 210, and this body 110 of cover 100 is designed to contain the entirety of ferrule 210 and bristles 214, utilizing a first opening 112 and body 110 which is larger than ferrule 210.

In embodiments, body 110 comprises a stretchable and conformable material and has an internal volume sufficient to contain the entirety of ferrule 210 and bristles 214. In embodiments, body 110 can also contain or cover some of handle 212, particularly where it meets with ferrule 210. Stretchable and conformable materials suitable for use in the present invention include, e.g., a knit material such as jersey, and woolen jersey; LYCRA® and spandex; latex rubber; neoprene synthetic rubbers; and blended materials such as, e.g., neoprene-spandex, cotton-spandex, polyester-spandex, stretch satin, stretch velvet, nylon-spandex, rayon knit-spandex, acetate-spandex, modal, TENCEL®-spandex, linen-spandex, stretch denim, cotton poplin stretch, faux leather, vinyl fabric, and stretch lace. In some embodiments, body 110 comprises a neoprene. In further embodiments, the neoprene comprises spandex. In additional embodiments, body 110 comprises spandex. In further embodiments, body 110 comprises neoprene, spandex, or a combination thereof.

The stretchable and conformable material of body 110 can have any suitable thickness. In embodiments, body 110 has a thickness of about 0.2 mm to about 5 mm, or about 0.5 mm to about 3 mm, or about 1 mm to about 2 mm. In additional embodiments, body 110 has a thickness of about 0.5 mm, about 0.6 mm, about 0.7 mm, about 0.8 mm, about 0.9 mm, about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, about 2.0 mm, about 2.1 mm, about 2.2 mm, about 2.3, mm, about 2.4 mm, about 2.5 mm, about 2.6 mm, about 2.7 mm, about 2.8 mm, about 2.9 mm, or about 3.0 mm. In certain embodiments, body 110 comprises neoprene and spandex and has a thickness of about 1 mm to about 2 mm. In additional embodiments, body 110 comprises neoprene and spandex and has a thickness of about 1.5 mm.

In embodiments, first opening 112 at first end 111 of body 110 is capable of receiving cosmetic brush 200 in a handle-first orientation, i.e., handle 212 of the cosmetic brush is the first portion of the cosmetic brush inserted into cover 100. In some embodiments, first opening 112 is stretchable, e.g., having an unstretched width $W_1$ smaller than the widest portion $W_F$ of ferrule 210 and configured to stretch as ferrule 210 is admitted through first opening 112. In such embodiments, first opening 112 has a width $W_1$ about 50%, about 60%, about 70%, about 80%, about 90%, or about 95% the width $W_F$ of ferrule 210. In alternate embodiments, first opening 112 has a larger or substantially the same width $W_1$ as the widest portion of $W_F$ of ferrule 210 such that ferrule 210 can be admitted through first opening 112 without stretching the first opening. In such embodiments, first opening 112 has a width $W_1$ about 99%, about 100%, about 105%, about 110%, about 120%, about 130%, about 140%, or about 150% of width $W_F$ as ferrule 210.

Figure 2C:
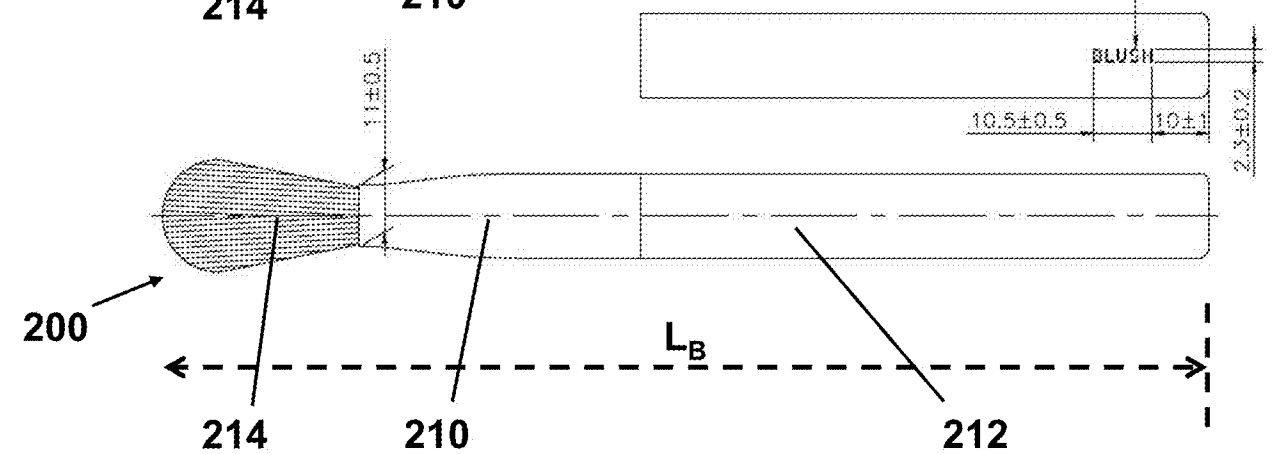

In embodiments, second opening 114 at second end 113 of body 110 is stretchable and has a width $W_2$ less than the widest portion $W_F$ of ferrule 210, e.g., as illustrated in FIGS. 1 and 2. In other embodiments, second opening 114 at second end 113 of body 110 is stretchable and has a width $W_2$ substantially the same as the widest portion $W_F$ of ferrule 210, e.g., as illustrated in FIGS. 3-5. In some embodiments, second opening 114 has a width $W_2$ about 50% to about 100%, about 80% to 99%, or about 90% to about 95% the width $W_F$ of ferrule 210. In certain embodiments, second opening 114 has a width $W_2$ about 50%, about 60%, about 70%, about 80%, about 90%, about 95%, about 99%, or about 100% the width $W_F$ of ferrule 210. Thus, in embodiments, second opening 114 is configured to fittingly engage handle 212 so as to limit movement of the handle through the second opening. In further embodiments, $W_1$ can be larger than $W_F$ of ferrule 210, so long as $W_2$ is smaller than $W_F$ to limit the brush falling through cover.

In certain embodiments, cosmetic brush 200 comprises relatively thin handle 212, ferrule 210, and/or bristles 214, e.g., as illustrated in FIGS. 3B, 4B, and 5B. Such cosmetic brushes may have a maximum width along the entire length LB of the brush of less than or about 1 cm, less than or about 0.9 cm, less than or about 0.8 cm, less than or about 0.7 cm, less than or about 0.6 cm, or less than or about 0.5 cm, and are typically used for application of thin, fine lines such as eyeliner, eyeshadow, lip liner, and/or touch-up of small areas of makeup. In embodiments, second opening 114 and first opening 112 of body 110 have substantially the same unstretched width, e.g., as illustrated in FIGS. 3A, 4A, and 5A. In additional embodiments, second opening 114 may have a width that is just slightly larger than the width of ferrule 210, but because of the nature of the material used in body 110, may still be able to retain the ferrule 210, bristles 214, and/or handle 212 within the cover to provide the desired protection In further embodiments, cosmetic brush 200 comprises ferrule 210 that includes a tapered width, e.g., the width of the ferrule decreases from the side in contact with bristles 214 to handle 212, as illustrated in FIGS. 1B and 2B. In embodiments, first opening 112 has a larger width $W_1$ than an unstretched width $W_2$ of second opening 114, and body 110 comprises a tapered portion 116 configured to limit movement of ferrule 210. In some embodiments, tapered portion 116 of body 110 substantially matches the taper of ferrule 210, thereby limiting movement of ferrule 210. In embodiments, width $W_2$ of second opening 114 is about 50% to about 100%, about 80% to 99%, or about 90% to about 95% the width $W_1$ of first opening 112. In embodiments, second opening 114 has a width $W_2$ about 50%, about 60%, about 70%, about 80%, about 90%, about 95%, or about 99% the width $W_1$ of first opening 112.

Advantageously, body 110 is capable of holding cosmetic brush 200 substantially in place due to: its ability to stretch and conform to the shape of the cosmetic brush; its width $W_2$ of stretchable second opening 114 being less than or substantially the same as $W_F$ of ferrule 210 (or in some embodiments, $W_2$ is just slightly larger than $W_F$); and/or due to its width $W_2$ of stretchable second opening 114 being less than width $W_1$ of first opening 112 and tapered portion 116 on body 110 configured to limit movement of ferrule 210. As used herein, "holding the cosmetic brush substantially in place" means that when the cosmetic brush is in the cover, the cover is configured to limit movement of the cosmetic brush, e.g., such that the cosmetic brush does not slip out of the cover without applying pushing or pulling force, even if turned upside down. Thus, in embodiments, the cover of the present invention provides secure storage of a cosmetic brush. In an embodiment wherein cosmetic brush 200 is secured in cover 100, handle 212 protrudes through second opening 114 at second end 113 of body 110, and ferrule 210 and bristles 214 are substantially encased by body 110.

In additional embodiments, brush 200 can comprise handle 212 that is wider than ferrule 210. In such embodiments, the covers 100 described herein can stretch to accommodate handle 212 through first opening 112, as well as second opening 114, while still allowing for holding cosmetic brush 200 substantially in place due to the ability of body 110 to conform and hold brush 200 either at ferrule 210 and/or part of handle 212.

In embodiments, body 110 further includes a flap 118 distally extending from first end 111 of body 110. As used herein, the term "distal" refers to a direction extending from first end 111 away from second end 113 along longitudinal axis LA (see FIG. 1A). Accordingly, the term "proximal" refers to an opposite direction from "distal," i.e., a direction extending from second end 113 away from first end 111 along longitudinal axis LA (see FIG. 1A). In some embodiments, flap 118 is configured to fold over body 110 to substantially cover first opening 112, e.g., flap 118 folds along first opening 112. Thus, in an embodiment wherein cosmetic brush 200 is secured in cover 100, flap 118 folds over body 110 to substantially cover first opening 112, thereby also covering bristles 214 and ferrule 210 encased substantially by body 110. The covering of first opening 112 by flap 118 advantageously prevents undesired contamination of bristles 214 and maintains their cleanliness when cosmetic brush 200 is stored in cover 100.

In additional embodiments, flap 118 comprises a closure mechanism 120 capable of attaching to body 110, e.g., as illustrated in FIGS. 1-5. In such embodiments, body 110 comprises a corresponding closure mechanism receiver 122, e.g., as illustrated in FIGS. 1-5. In embodiments, closure mechanism 120 and corresponding receiver 122 of the closure mechanism are configured to secure flap 118 to body 110 such that the flap remains closed, i.e., substantially covering first opening 112. Examples of closure mechanisms and receivers thereof suitable for use in the present invention can include, e.g., hook and loop fasteners such as VELCRO®, hook and eye fasteners, magnetic fasteners, snap fasteners, loop fasteners, zipper, button and button receiver (e.g., loop or hole), buckle, and the like. In some embodiments, closure mechanism 120 comprises a hook and loop fastener, a magnetic fastener, a snap closure, a zipper, or a button, and body 110 comprises receiver 122 of the closure mechanism. Methods of including a closure mechanism on flap 118 and closure mechanism receiver 122 on body 110 are known to the ordinarily skilled artisan. In other embodiments, body 110 comprises a receiver, e.g., a loop or pocket, into which flap 118 can be inserted directly, i.e., flap 118 is the closure mechanism.

In further embodiments, when a user wishes to remove cosmetic brush 200 from cover 100, flap 118 does not need to be opened (i.e., closure mechanism 120 does not need to be disengaged from closure mechanism receiver 122). In such embodiments, cosmetic brush 200 is retrieved from the cover by pulling on handle 212, thereby pulling ferrule 210 and bristles 214 through stretchable second opening 114. Thus, by enabling flap 118 to remain closed during removal of cosmetic brush 200, fewer sources of contamination are likely to be introduced into cover 100, further serving to maintain cleanliness of the cosmetic brush.

In yet further embodiments, flap 118 has a length less than or substantially equal to the length of body 110. In some embodiments, flap 118 is about 10% to about 100%, or about 20% to about 80%, or about 30% to about 70%, or about 40% to about 60% the length of body 110. In some embodiments, flap 118 is about 10%, about 20%, about 30%, about 40%, about 50%, about 60%, about 70%, about 80%, about 90%, or about 100% the length of body 110.

Figure 6A:
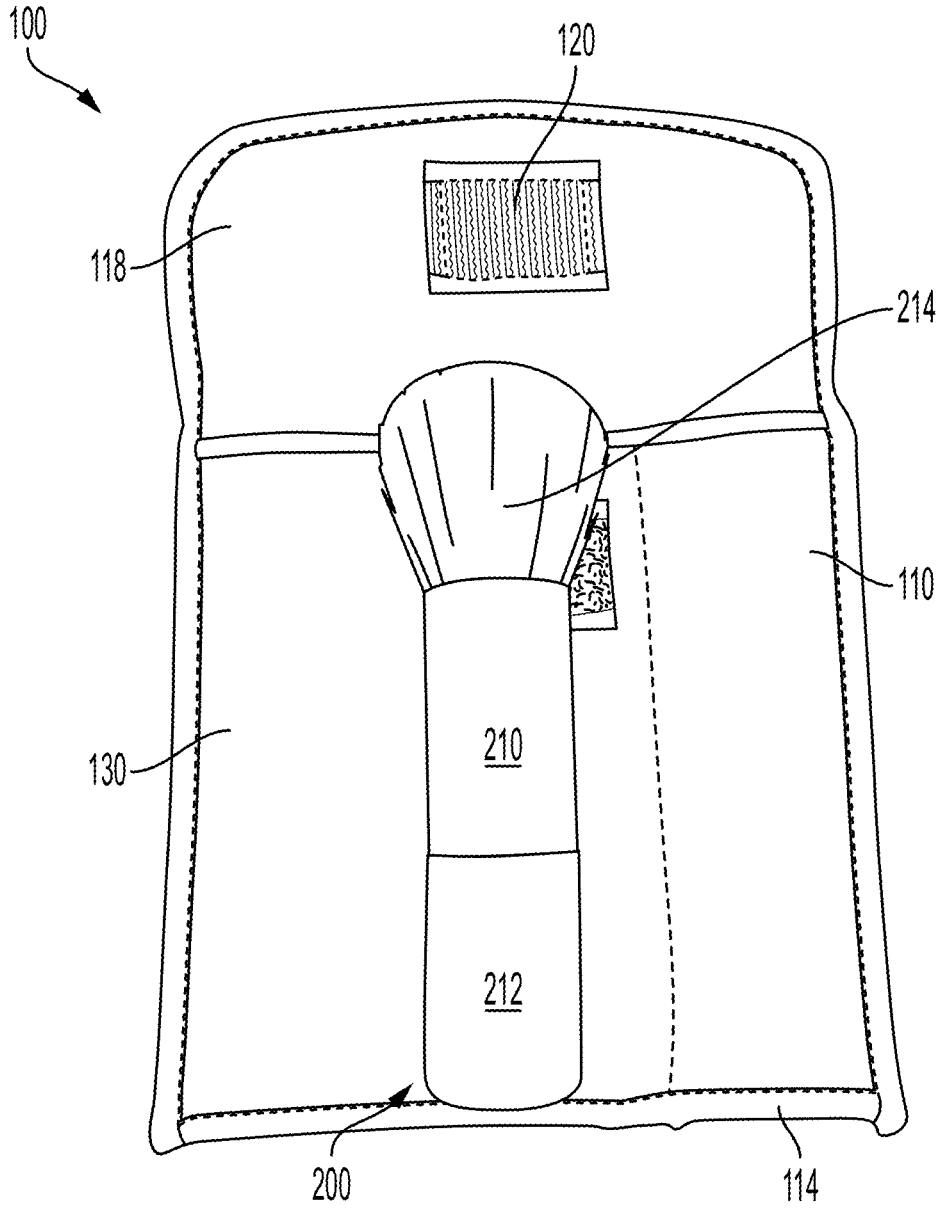
FIGS. 6A-6B illustrate a cosmetic brush and a cover for the cosmetic brush including a sleeve for a makeup container, according to embodiments herein.
Figure 6B:
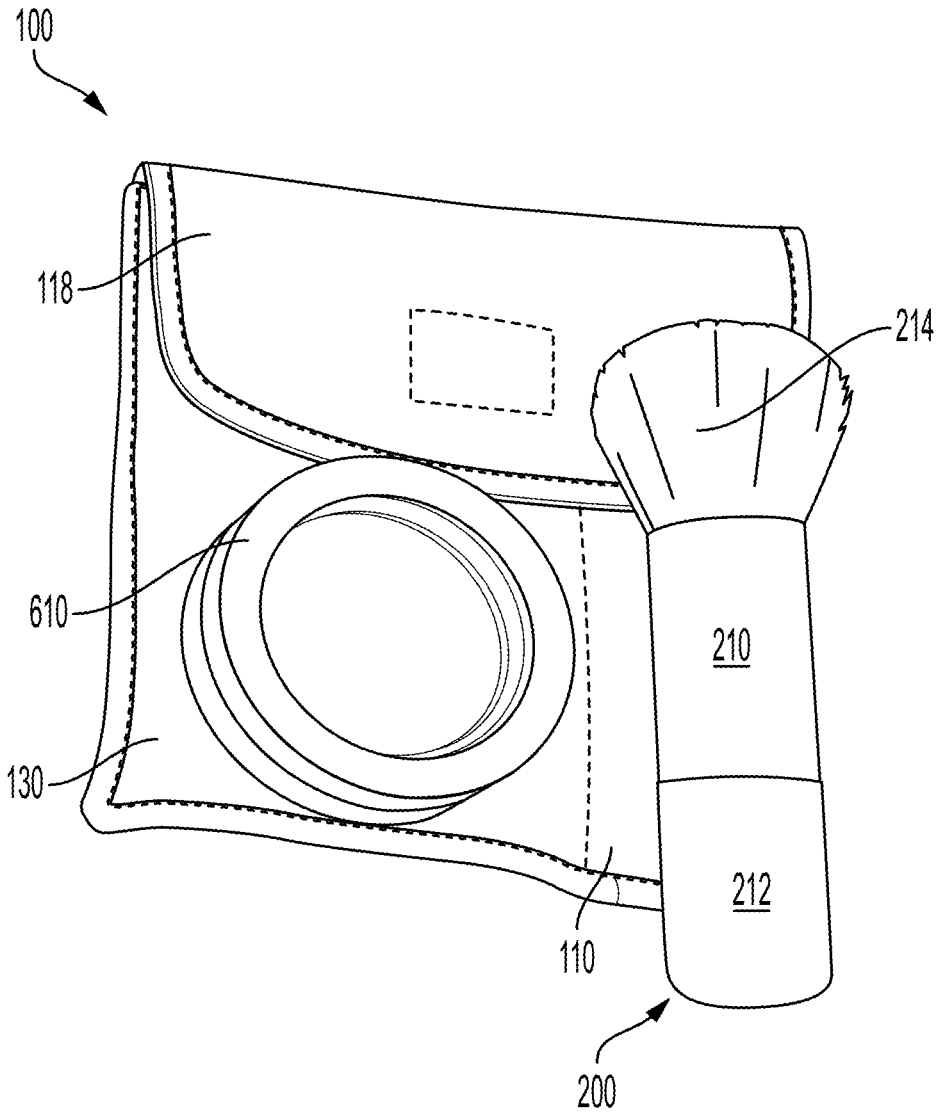

In some embodiments, cover 100 further comprises a sleeve 130 configured to hold a makeup container, e.g., as illustrated in FIG. 6A. Sleeve 130 can comprise the same material, or a different material as cover 100. In some embodiments, sleeve 130 comprises a stretchable and conformable material. In further embodiments, sleeve 130 comprises neoprene and spandex. The makeup container can be any suitable container, and sleeve 130 can have a shape substantially the same as the makeup container. FIG. 6B shows an embodiment of cover 100 further comprising sleeve 130 for holding makeup container 610. Examples of makeup containers include a makeup compact (e.g., a blush compact), lipstick or lip gloss, and container suitable for storage of liquids such as essence, toner, fragrance, makeup remover, and the like; creams; and/or lotions. In some embodiments, the makeup container includes a pump, lid or cap and a base container. The lid or cap may be, e.g., a threaded lid or cap that is detachable from the container, or a lid or cap attached to the container via a hinge or other suitable attachment. In some embodiments, the makeup container is a makeup compact. In some embodiments, the makeup compact comprises a lid coupled to a base container, e.g., via a hinge. In embodiments, the makeup container stored in sleeve 130 of cover 100 includes a makeup suitable for application using cosmetic brush 200 stored in the cover. For example, the cosmetic brush may be a blush brush, and the sleeve is configured to hold a blush makeup compact; the cosmetic brush may be an eyeshadow brush, and the sleeve is configured to hold an eyeshadow palette; and/or the cosmetic brush may be a liner brush, and the sleeve is configured to hold an eye liner and/or lip liner. Thus, in some embodiments, cover 100 provides a simple and convenient storage of both a makeup and an appropriate cosmetic brush for application thereof.

In still further embodiments, provided herein is a multi-brush cover configured to hold more than one cosmetic brush. In particular, such a multi-brush cover conveniently allows a user to store multiple cosmetic brushes, e.g., cosmetic brushes of different types, in a single device, and also facilitates transport of multiple cosmetic brushes. In some embodiments, a plurality of covers 100 are arranged adjacent to one another such that the longitudinal axes LA of the covers are substantially parallel to one another. In some embodiments, plurality of covers 100 are attached to one another directly, i.e., body 110 of a cover is directly in contact with body 110 of an adjacent cover. In other embodiments, each cover 100 in the plurality of covers is attached to a connecting means, e.g., a fabric or other structural material that spans the entire width of the plurality of covers, such that each cover is not in contact with an adjacent cover. In other embodiments, a single piece of fabric can contain multiple covers 100 attached to the single piece of fabric resulting in a plurality of covers in a multi-brush cover configuration. In some embodiments, the multi-brush cover is configured to be rolled or folded, e.g., for storage and/or transportation.

Figure 7:
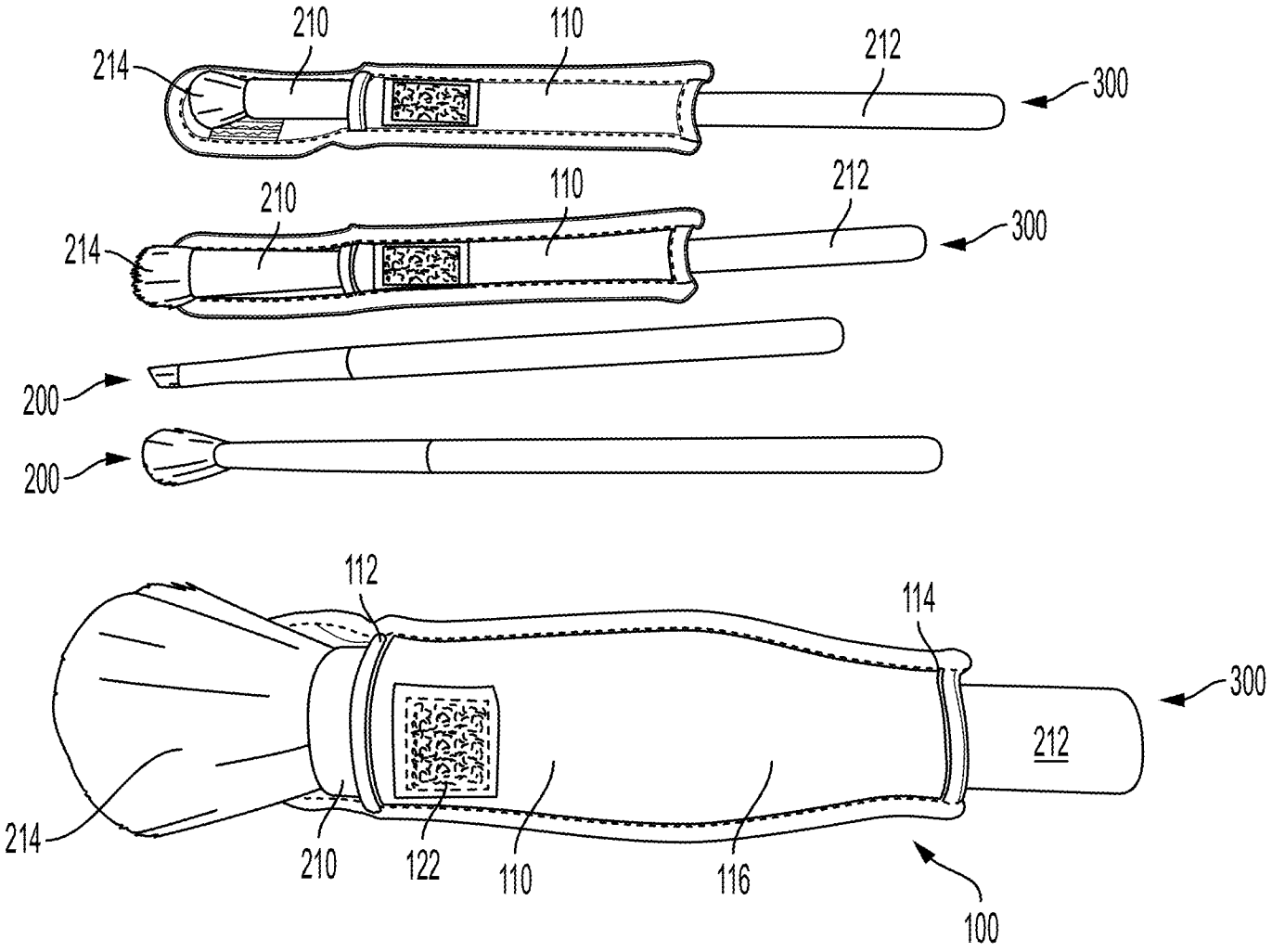
FIG. 7 illustrates cosmetic brushes having various shapes and covers for the cosmetic brushes, according to embodiments herein.

Further provided herein is a covered cosmetic brush 300 (see FIG. 7). In some embodiments, covered cosmetic brush 300 comprises a cosmetic brush 200 including a handle 212 and a ferrule 210 with bristles 214; and a cover 100 comprising a body 110 having substantially the same shape of the ferrule and bristles, the body comprising neoprene, spandex, or combination thereof and having an internal volume sufficient to contain the entirety of the ferrule and the bristles; a first opening 112 at a first end 111 of the body for receiving the cosmetic brush in a handle-first orientation; a stretchable second opening 114 at a second end 113 of the body, the second opening being less than or substantially the same width as the ferrule and capable of stretching to admit the ferrule therethrough, as well as bristles 214, which in embodiments, can extend beyond ferrule; and a flap 118 distally extending from the first end of the body and having a length less than or substantially equal to the length of the body, the flap configured to fold over the body to cover the first opening and comprising a hook and loop fastener for attachment to a corresponding hook and loop fastener on the body, wherein the cover holds the cosmetic brush substantially in place.

In additional embodiments, the covered cosmetic brush further comprises a sleeve configured to hold a makeup container. In yet further embodiments, the makeup container is a makeup compact comprising a lid coupled to a base container. Examples of makeup containers, including makeup compacts, are provided herein.

Figure 8:
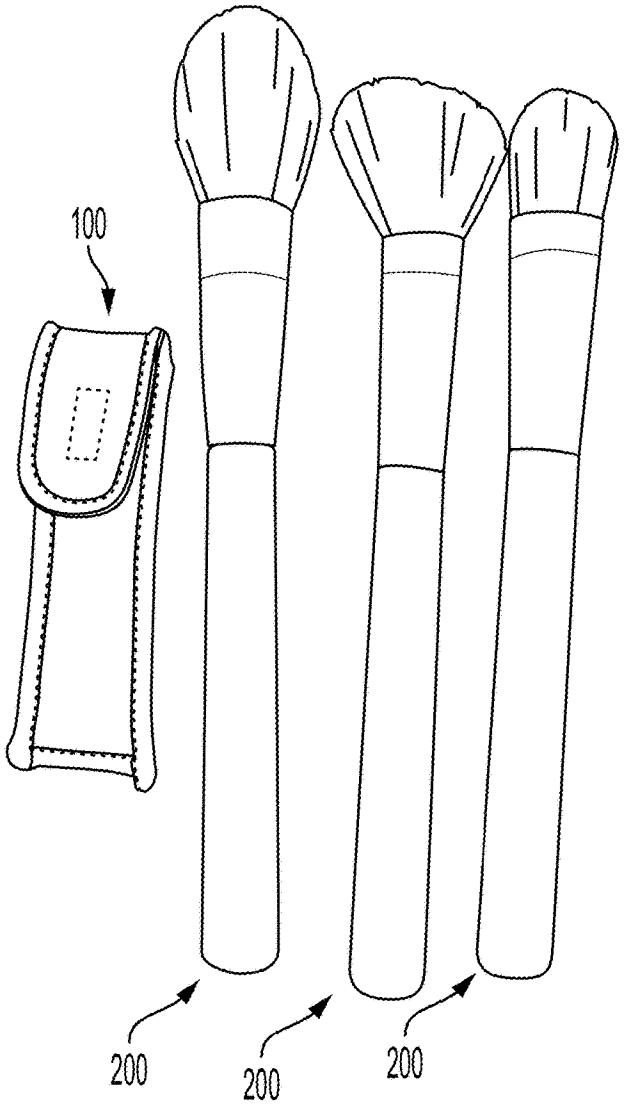
FIG. 8 further illustrates cosmetic brushes having various shapes and covers for the cosmetic brushes, according to embodiments herein.
Figure 8:
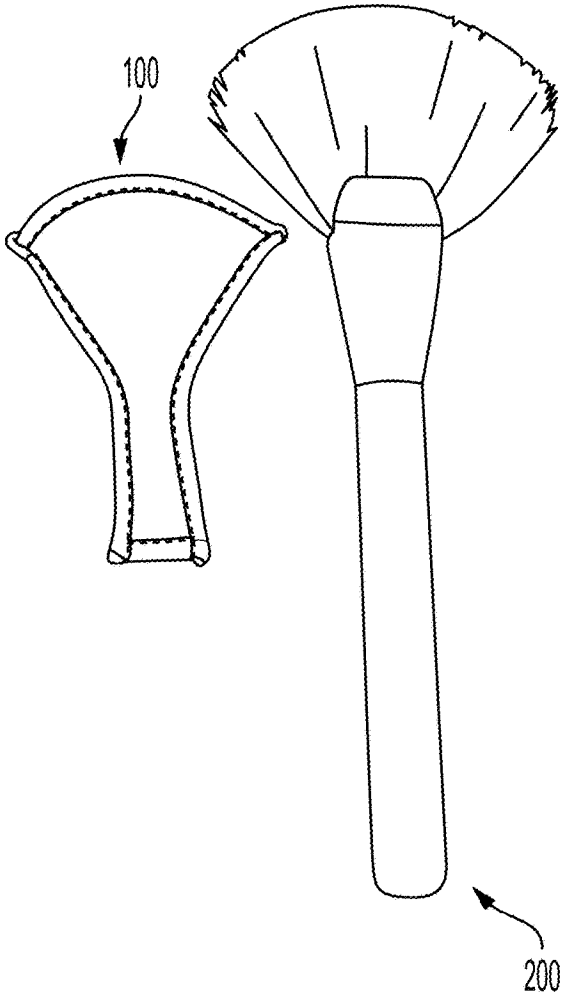

FIGS. 7 and 8 illustrate examples of cosmetic brushes 200 of various shapes and sizes that are suitable for the covers of the present disclosure, as well as covered cosmetic brushes 300. FIG. 7 additionally illustrates partially covered cosmetic brushes (i.e., the flaps are not folded over the body in the illustrated configuration, in order to show the bristles of the various brushes). In some embodiments, the cosmetic brush is a fan brush, an angled brush, a powder brush, a blender brush, a bronzer brush, a crease brush, an eye liner brush, or combination thereof. In some embodiments, the shape of bristles 214 is not substantially deformed by cover 100, as described herein. Cosmetic brushes 200 and the corresponding covers 110 shown in FIGS. 7-8 are for illustrative purposes and are not limiting on the sizes, configurations or relationships between components of the brushes and covers.

While various embodiments have been described above, it should be understood that they have been presented only as illustrations and examples of the present invention, and not by way of limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment.

What is claimed is:

1. A covered cosmetic brush, comprising:

a cosmetic brush including a handle, a ferrule, and bristles; and a cover comprising a body having substantially the same shape of the ferrule and bristles, the body comprising neoprene, spandex, or combination thereof and having an internal volume sufficient to contain the entirety of the ferrule;

a first opening at a first end of the body for receiving the cosmetic brush in a handle-first orientation;

a stretchable second opening at a second end of the body, wherein an unstretched width of the second opening is 80% to 99% of a widest portion of the ferrule, and wherein the second opening is capable of stretching to admit the ferrule therethrough; and a flap distally extending from the first end of the body and having a length less than or substantially equal to the length of the body, the flap configured to fold over the body to cover the first opening and comprising a closure mechanism, wherein the cover holds the cosmetic brush substantially in place, and wherein a shape of the bristles is not substantially deformed by the cover; and wherein the cosmetic brush is a fan brush, an angled brush, a powder brush, a blender brush, a bronzer brush, a crease brush, an eye liner brush, or combination thereof.

2. The covered cosmetic brush of claim 1, further comprising a sleeve configured to hold a makeup container.

3. The covered cosmetic brush of claim 2, wherein the makeup container comprises a makeup compact, a lipstick, a lip gloss, or a container for storage of liquids.

4. The covered cosmetic brush of claim 1, wherein the body comprises neoprene and spandex and has a thickness of about 1.5 mm.

5. The covered cosmetic brush of claim 1, wherein the body comprises a thickness of about 1 mm to about 2 mm.

6. The covered cosmetic brush of claim 1, wherein the unstretched width of the second opening is 90% to 95% of the widest portion of the ferrule.

7. The covered cosmetic brush of claim 1, wherein the unstretched width of the second opening is less than the width of the body.

8. The covered cosmetic brush of claim 1, wherein the first and second openings have substantially the same unstretched width.

9. The covered cosmetic brush of claim 1, wherein the first opening has a larger width than an unstretched width of the second opening, and the body comprises a tapered portion configured to limit movement of the ferrule.

10. The covered cosmetic brush of claim 1, wherein the closure mechanism comprises a hook and loop fastener, a magnetic fastener, a snap closure, a zipper, or a button, and the body comprises a receiver of the closure mechanism.

11. The covered cosmetic brush of claim 1, wherein the flap comprises a hook and loop fastener that is capable of attaching to a corresponding hook and loop fastener on the body.

* * * * *